United States Patent [19]

Hahn

[11] 4,188,735

[45] Feb. 19, 1980

[54] ADJUSTABLE SEMI-FLEXIBLE HEALTH SHOE

[76] Inventor: John E. Hahn, 11320 SW. Viewmount Ct., Tigard, Oreg. 97223

[21] Appl. No.: 890,386

[22] Filed: Mar. 27, 1978

[51] Int. Cl.[2] ..... A43B 3/12

[52] U.S. Cl. ..... 36/11.5

[58] Field of Search ..... 36/11.5, 50, 53

[56] References Cited

U.S. PATENT DOCUMENTS

| | | | |
|---|---|---|---|
| 3,228,124 | 1/1966 | Schwartz | 36/11.5 |
| 3,584,402 | 6/1971 | Silverman | 36/11.5 |
| 3,739,501 | 6/1973 | Barrett | 36/11.5 |
| 3,968,577 | 7/1976 | Jackson | 36/11.5 |

*Primary Examiner*—Patrick D. Lawson

*Attorney, Agent, or Firm*—A. William King

[57] ABSTRACT

An adjustable semi-flexible shoe is disclosed which is structurally and isometrically adapted for controllably stably supporting a human foot during walking following surgical and therapeutical treatment of the user's lower extremities while simultaneously permitting an approximated natural gait. A laminated elongate sole of semi-flexible polymeric materials has an upper sole laminate which stably supports the foot substantially free of compression while permitting limited longitudinal flexing and a lower outer sole laminate with a substantially flat surface extending from the metatarsal area through the heel area and an upwardly tapered surface in the toe area which affords cushioned approximated natural ambulation. A single integral canvas upper has a lower portion extending transversely through the sole and upper flaps which are adjustably releasably connected with one another to adjustably stably secure the user's foot to the sole.

4 Claims, 4 Drawing Figures

FIG. 1
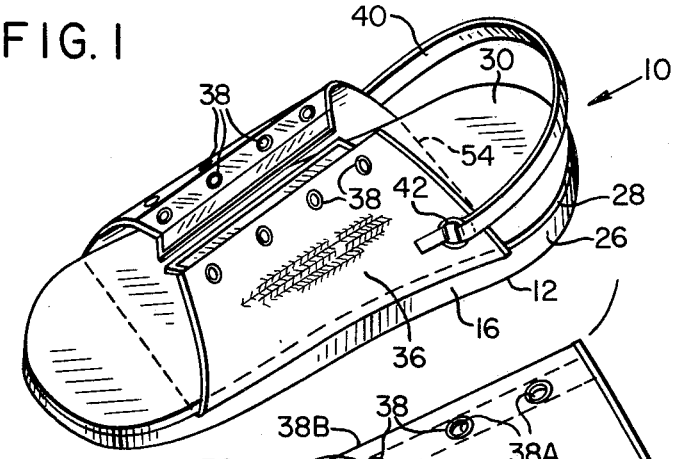
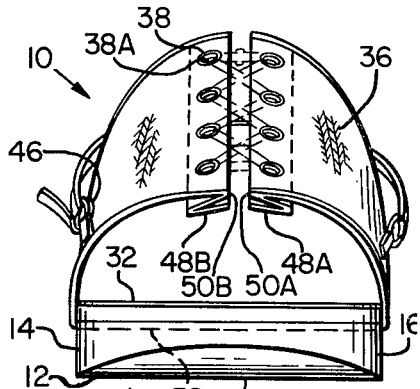
FIG. 3
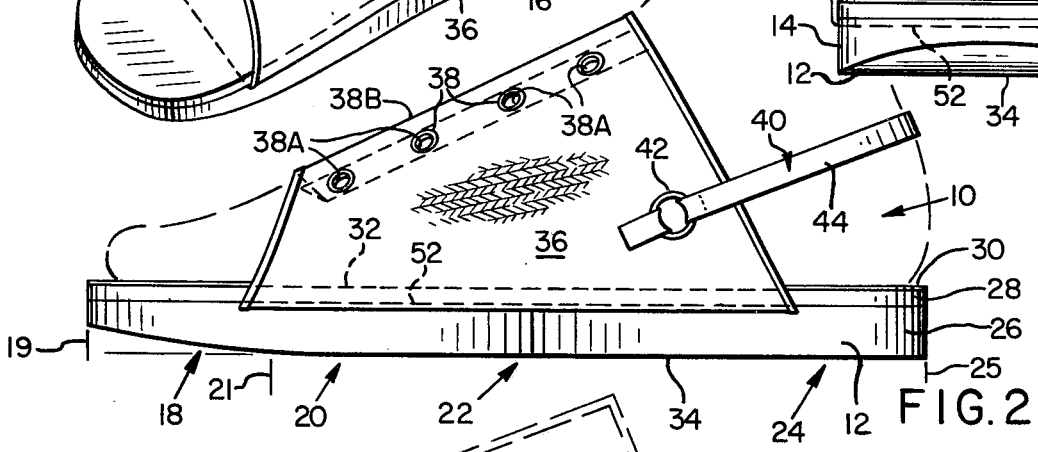
FIG. 2
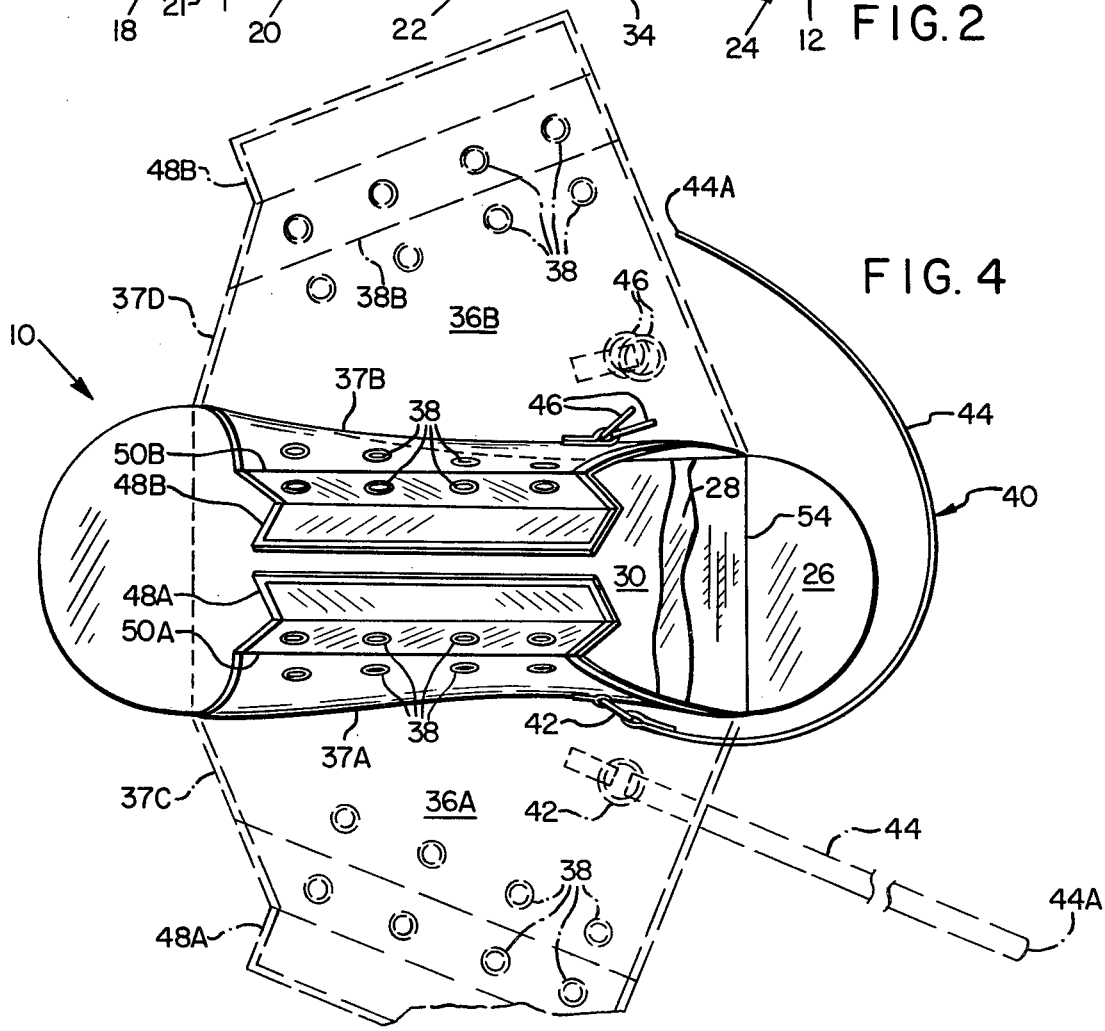
FIG. 4

ADJUSTABLE SEMI-FLEXIBLE HEALTH SHOE

BACKGROUND OF THE INVENTION

The present invention relates to shoes for the human feet and particularly relates to a shoe for stably supporting a human foot during ambulation following surgical treatment of the user's lower extremities, commonly termed "post-op shoes", and therapeutic treatment of same for sprains, fractures and the like, herein referred to collectively as "health shoes".

It is particularly important to stably support or substantially immobilize a patient's foot during ambulation following such treatment because relative movements of the joints of the lower extremities as occur during natural ambulation tend to aggravate the initial trauma. The problem is especially compounded by the need to maintain costs of medical treatment within acceptable limits and by the relatively short period of time during which the shoes are to be used. In this respect, it is important to note that casts, bandaging and swelling commonly distort the shape of the human foot thereby complicating the task of foot stabilization and necessitating that a wide range of various sized shoes be maintained. It will be appreciated that these latter factors dictate a shoe which is relatively uncomplex and thereby inexpensive to manufacture.

In order to balance the above-described competing factors, health shoes have been heretofore presented having a rigid sole of unitary construction, typically of wood, for stably supporting the user's foot, such shoes further having an open-toe, enclosed heel upper mounted as a loop atop the sole for stably securing the user's foot to the shoe when placed therein. A major disadvantage of such construction is that the rigid sole causes an awkward gait rendering the shoe extremely uncomfortable and substantially increasing the risk that unsupervised patients will omit use thereof. Another major disadvantage of known health shoes is that the rigid unitary construction has precluded effective long-lasting attachment of the plastic upper to the shoe. During use, the enhanced forces caused by the awkward ambulation inherent to rigid construction tends to destroy conventional fastening bonds provided by stitches, staples and adhesives thereby eliminating the ability of the upper to stably secure the user's foot to the sole.

It is also important to note that shoes having flexible soles have been presented which are adapted to receive a cast foot, commonly referred to as "cast shoes". Cast shoes, however, rely upon the stability afforded by the cast and are therefore inherently unable to function as a post-op shoe.

SUMMARY OF THE INVENTION

The present invention provides an adjustable semi-flexible shoe which is structurally and isometrically adapted for both stably supporting a human foot during ambulation following surgical and other therapeutical treatment of the user's lower extremities and simultaneously permitting an approximated natural gait, herein referred to as a "health shoe".

The exemplary health shoe of the present invention includes an elongate isometrically-shaped sole of semi-flexible construction having suitable cross section and configuration for stably supporting the user's foot thereon, a lateral side, medial side, and toe, metatarsal, midsole and heel supportive areas. In particular, the exemplary sole includes a lower outer sole laminate of resilient partially deformable material, an upper inner sole laminate of semi-flexible polymeric material being significantly incompressible and partially longitudinally flexible by the user's weight and an uppermost coating of relatively smooth durable material. It is particularly important to note that the present sole includes substantially flat top and bottom surfaces, the bottom major surface tapering upwardly from the forward extremity of said metatarsal area to the front portion of said toe area.

The significance of the above-described semi-flexible construction is that the upper inner sole laminate provides a stable platform for supporting the user's foot while the lower outer sole laminate provides shock absorption during ambulation. More importantly, this dual sole construction combines with the isometric shape of the sole to permit a significantly approximated natural gait thereby providing both stable support and comfortable ambulation to encourage use of the shoe.

Stable securement of the user's foot is provided by an open-toe, open-heel canvas upper comprising elongate lateral and medial flaps, each flap having a lower lateral edge fixedly attached respectively to the lateral and medial sides of the sole at a plurality of points extending from proximate the forward extremity of the metatarsal area through the midsole area to the heel area and an upper section extending generally transversely relative to the sole for a distance greater than one-half the minimum sole width, and a fastener for connecting the lateral and medial flaps with one another thereby forming a loop having a determinable length. Further, an elongate strap is provided for urging the user's foot forwardly against the lateral and medial flaps, the strap having opposing ends attached respectively to the lateral and medial flaps and a heel retaining portion of determinable length extending rearwardly from the flaps over the heel area.

In order to insure the fastening integrity of the canvas upper, an elongate slot is formed in the sole extending transversely therethrough from the lateral side to the medial side and, thereafter, portions of the lateral and medial flaps are placed within the slots and are bonded to the wall means defining the slot. It will be seen that this construction fixedly attaches the lower lateral edges of the flaps to the sole substantially continuously along the distance from proximate the forward extremity of the metatarsal area to the heel area.

Yet other important features of the preferred embodiment of the present health shoe include attaching lateral and medial folds respectively to the lateral and medial flaps for comfortably separating uppermost portions of the flap from the user's feet. Preferably, the flaps and folds constitute one integral piece so as to simplify construction. Futher both the heel strap and the fastener for the canvas upper include means for selectively adjustably varying the determinable length of the heel retaining portion and loop respectively. It will be seen that these features permit the shoe to accomodate widely varying foot sizes caused by casts, bandages, swelling and the like.

It is therefore a major objective of the present invention to overcome the above-stated drawbacks of heretofore presented health shoes while simultaneously providing a relatively uncomplex shoe which is readily and inexpensively manufactured.

Yet further features, advantages and objectives of the present invention will become apparent, and the full nature of the invention will be more readily understood from the accompanying drawings and the following description and claims.

BRIEF DESCRIPTION OF THE DRAWINGS

FIG. 1 is a top perspective of an exemplary health shoe of the present invention.

FIG. 2 is a front perspective of the shoe of FIG. 1.

FIG. 3 is a side view of the shoe of FIG. 1.

FIG. 4 is a partial top view of the shoe of FIG. 1.

DETAILED DESCRIPTION OF THE INVENTION

Referring now particularly to the drawings, there is shown an exemplary embodiment of the present invention wherein the numeral 10 refers generally to a health shoe.

The health shoe 10 is provided with an elongate isometrically-shaped sole 12 having suitable cross section and configuration for receiving and stably supporting thereon the user's foot. The sole includes a lateral side 14, medial side 16, toe 18, metatarsal 20, midsole 22 and heel 24 supportive areas. In particular, the sole is constructed in layers including a lower outer sole laminate 26, an upper inner sole laminate 28 and an uppermost vinyl coating 30. The importance of this layer construction is that the outer sole laminate is of resilient, partially deformable polymeric material for providing shock absorption during ambulation; whereas the inner sole laminate is of flexible polymeric material being significantly incompressible and longitudinally flexible by the user's weight thereby providing the prerequisite stable support.

It is particularly important to note that the present sole 12 is isometrically-shaped to provide both a stable platform for the user's foot and a significantly approximated natural gait during ambulation. In particular, the sole is provided with substantially flat top and bottom major surfaces 32 and 34, the bottom major surface being substantially flat from the rearward extremity 25 of the heel area 24 to the forward extremity 21 of the metatarsal area 20 and thereafter, having an upwardly extending tapered flat surface extending to proximate the front 19 of the toe area 18.

In order to stably secure the user's foot atop the sole 12, the preferred embodiment of the present health shoe 10 also includes an open-toe, open heel upper 36 preferably of canvas material, fastener means 38 and a heel strap 40.

The upper 36 is provided with elongate lateral and medial flaps 36A and 36B, respectively, each having a lower lateral edge 37A and 37B fixedly attached respectively to the lateral and medial sides 14 and 16 at a plurality of points extending from proximate the forward extremity 21 of the metatarsal area through the midsole area 22 to the heel area 24, and upper sections 37C and 37D extending generally transversely relative to the sole 12 for a distance greater than one-half of the minimum width of the sole.

The preferred fastener means 38 is seen to comprise means defining a plurality of corresponding apertures 38A in the upper lateral edges 38B of the lateral and medial flaps 36A and 36B together with a flexible elongate lacing (not shown). Such construction permits the flaps 36A and 36B to be formed into an openable loop above the sole of determinable length for closely receiving the user's foot. More importantly it provides means for selectively adjustably varying the determinable length of the loop to accomodate a wide range of foot sizes including those irregular sizes caused by casts, bandages, swelling and the like.

It is of primary importance to form the flaps 36A and 36B of canvas or like material having an excellent breathing characteristic because this will enhance user's comfort and thereby stimulate use of the shoe. Further, it is similarly important to provide the upper 36 with both open-toe and open-heel construction since this enhances such comfort and lends itself to permitting the shoe 10 to accept the wide range of foot configurations.

The heel strap 40 includes a ring 42 mounted on the rearward edge of one of the flaps 36A and 36B, an elongate strap 44 of determinable length and of flexible durable material such as canvas attached to the ring 42 and a pair of corresponding retaining rings 46 mounted on the rearward edge of the opposing flap 36A and 36B. In use, the elongate strap is disposed behind the heel of the user's foot with the loose end 44A suitably disposed through the retaining rings. In this fashion, the determinable length of the elongate strap is selectively adjustably varied to accomodate a given-sized heel and urge the user's foot forwardly against the flaps. It is to be understood that alternative fastening methods such as buckles, opposing strips of hook and loop material sold under the name "Velcro" and the like can be used with the elongate strap without departing from the scope of the invention.

A significant feature of the present invention is to provide the lateral and medial flaps 36A and 36B with generally N-shaped lateral and medial folds 48A and 48B suitably fastened along the upper lateral edges 50A and 50B of the lateral and medial flaps so as to be interposed between same and the user's foot. In this fashion the user's foot is protected from the strictures of the lacing further enhancing user comfort.

Yet another significant feature of the present invention is to provide the sole 12 with means defining an elongate slot 52 extending transversely through the sole from the lateral side 14 to the medial side 16. Accordingly, the bottom portion 54 of the upper 36 can be disposed in the elongate slot and bonded to the interior of the sole thereby fixedly attaching the lower lateral edges 37A and 37B of the flaps 36A and 36B to the sole substantially continuously along the distance from proximate the forward extremity 21 of the metatarsal area 20 to the heel area 24. Such fastening both significantly increases the stable securement of the user's foot by the upper and obviates the problem of foot forces impairing the integrity of the upper fastening. Further, this construction permits both the flaps 36A and 36B and folds 48A and 48B to be one integral piece thereby significantly reducing the labor and expense of manufacturing the shoe.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An adjustable semi-rigid post-operative shoe adapted to be worn on either foot during ambulation following surgical and other therapeutical treatment of the user's lower extremities, comprising:

(a) an elongate sole of durable polymeric material having a generally semi-circular toe end portion of predetermined cross section, a generally semi-circular heel end portion of predetermined cross section less than that of said toe end portion, opposing lateral and medial sides, a top major surface adapted to directly engage said foot and a bottom major surface adapted to engage a supportive surface during ambulation, said sides each being generally concave in longitudinal cross section from said toe end portion to said heel end portion providing said sole with a minimum width adjacent the midsole area thereof;

(b) open-toe and open-heel means for stably securing said user's foot atop said sole being characterized by elongate lateral and medial flaps of durable, flexible material having good breathing characteristics, each flap having a lower lateral edge fixedly attached respectively to said lateral and medial sides at a multiplicity of points along the length of said lateral and medial sides, each flap further having an upper section extending respectively from each said lateral edge transversely across said sole for a distance significantly greater than one-half said minimum width;

(c) fastener means for connecting said lateral and medial flaps with one another thereby forming a first loop of determinable length; and (d) strap means of durable, flexible material for urging said user's foot forwardly against said lateral and medial flaps, and having opposing ends attached respectively to said flaps and a heel retaining portion of determinable length forming a second loop extending rearwardly from said lateral and medial flaps over the heel area of said shoe.

2. The shoe of claim 1 wherein said fastener means includes first adjustment means for both opening and movably adjusting the length of said first loop, wherein said lateral and medial flaps include respectively lateral and medial fold means of durable smooth material for cushioningly separating said user foot from both the uppermost portions of said flaps and from said first adjustment means, and wherein said strap means includes second adjustment means separated from said user's foot by one of said flaps for both opening and movably adjusting the length of said second loop.

3. An adjustable semi-rigid post-operative shoe adapted to be worn on either foot during ambulation following surgical and other therapeutical treatment of the user's lower extremities, comprising:

(a) an elongate isometrically-shaped sole of semi-flexible construction having suitable cross section and configuration for receiving and stably supporting said user's foot thereon, opposing lateral and medial sides, a top major surface adapted to directly engage said foot and a bottom major surface adapted to engage a supportive surface during ambulation;

(b) open-toe and open-heel means for stably securing said user's foot atop said sole and significantly maintaining contact between said user's foot and said upper sole laminate during ambulation being characterized by elongate lateral and medial flaps of durable, significantly inelastic material having good breathing characteristics, each flap having a lower lateral edge fixedly attached respectively to said lateral and medial sides at a multiplicity of points along the length of said lateral and medial sides, each flap further having an upper section extending respectively from each said lateral edge transversely across said sole for a distance significantly greater than one-half said minimum width;

(c) fastener means for connecting said lateral and medial flaps with one another thereby forming a loop of determinable length;

(d) strap means of durable, significantly inelastic material for urging said user's foot forwardly against said lateral and medial flaps, and having opposing ends attached respectively to said flaps and a heel retaining portion of determinable length forming a second loop extending rearwardly from said lateral and medial flaps over the heel area of said shoe; and (e) said sole including means for stably supporting the user's foot during ambulation characterized by:

(i) an upper sole laminate directly engaging the user's foot of resilient polymeric material being significantly incompressible by the user's weight while permitting controllably limited longitudinal flexing, and (ii) a lower sole laminate directly supporting and bonded to the upper sole laminate of durable, resilient partially-deformable polymeric material for absorbing shock during ambulation as said lower sole laminate engages a supportive surface.

4. The shoe of claim 3 where said sole further includes means for permitting controllable rocking motion during ambulation thereby approximating a natural gait and being characterized by said bottom major surface of said sole defining a substantially continuous plane from its most rearward extremity to a position forward of the midsole area and thereafter defining a generally arcial plane tapering upwardly to its most forward extremity.

* * * * *